US005758914A

United States Patent [19]

Ioveno

[11] Patent Number: 5,758,914

[45] Date of Patent: Jun. 2, 1998

[54] GARBAGE CAN LID TETHER

[76] Inventor: Joseph Ioveno, 926 Karshick St., Bohemia, N.Y. 11716

[21] Appl. No.: 780,618

[22] Filed: Jan. 8, 1997

[51] Int. Cl.[6] ..... E05C 19/18

[52] U.S. Cl. ..... 292/288; 292/258; 24/301; 24/302; 220/375

[58] Field of Search ..... 24/502, 514, 298–302; 292/288, 258, 262; 220/315, 318

[56] References Cited

U.S. PATENT DOCUMENTS

| | | | |
|---|---|---|---|
| 1,513,920 | 11/1924 | Menefee | 220/324 |
| 1,732,098 | 10/1929 | Lessenhop | 220/375 |
| 2,225,875 | 12/1940 | Liebmann | 24/502 |
| 2,525,505 | 10/1950 | Wiedman | 24/514 |
| 3,124,381 | 3/1964 | Geldart | 292/288 |
| 3,158,393 | 11/1964 | King | 292/288 |
| 3,291,515 | 12/1966 | Lierman | 292/288 |
| 3,358,874 | 12/1967 | Smith | 220/318 |
| 3,363,924 | 1/1968 | Remig | 292/258 |
| 3,503,535 | 3/1970 | Sparks, Sr. | 292/288 |
| 3,589,760 | 6/1971 | Williams | 292/244 |
| 3,649,954 | 3/1972 | Kurtz | 24/502 |
| 3,980,202 | 9/1976 | Monyak et al. | 292/288 |
| 4,009,897 | 3/1977 | Spellman . | |
| 4,043,368 | 8/1977 | Forte, Sr. | 220/375 |
| 4,241,846 | 12/1980 | Murphy | 292/258 |
| 4,339,056 | 7/1982 | Berkstresser, Jr. et al. | 220/375 |
| 4,413,851 | 11/1983 | Ritter . | |
| 4,545,501 | 10/1985 | DeFord | 220/318 |
| 4,616,384 | 10/1986 | Lowell et al. | 24/502 |
| 4,723,686 | 2/1988 | Pennisi . | |
| 5,078,295 | 1/1992 | Grant | 292/288 |
| 5,297,692 | 3/1994 | Kronmiller | 292/288 |
| 5,302,039 | 4/1994 | Omholt | 24/514 |
| 5,655,270 | 8/1997 | Boisvert | 24/301 |
| 5,675,841 | 10/1997 | Jackson | 24/302 |

*Primary Examiner*—Darnell M. Boucher
*Attorney, Agent, or Firm*—Terrance L. Siemens

[57] ABSTRACT

An elastic, jawed tether for securing a lid to an associated container, such as a garbage can. The tether comprises an elongated strap terminating at each end in a jawed clamp. The clamp has a self-locking device, such as a cam arrangement, and a screw for closing and locking the jaws in place. A swivel bearing connects each clamp to the strap, so that the clamps have no tendency to twist the strap.

3 Claims, 2 Drawing Sheets

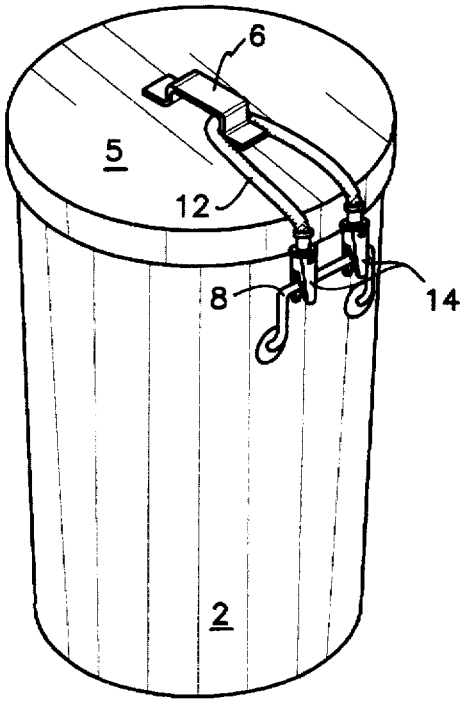
FIG. 3
FIG. 2
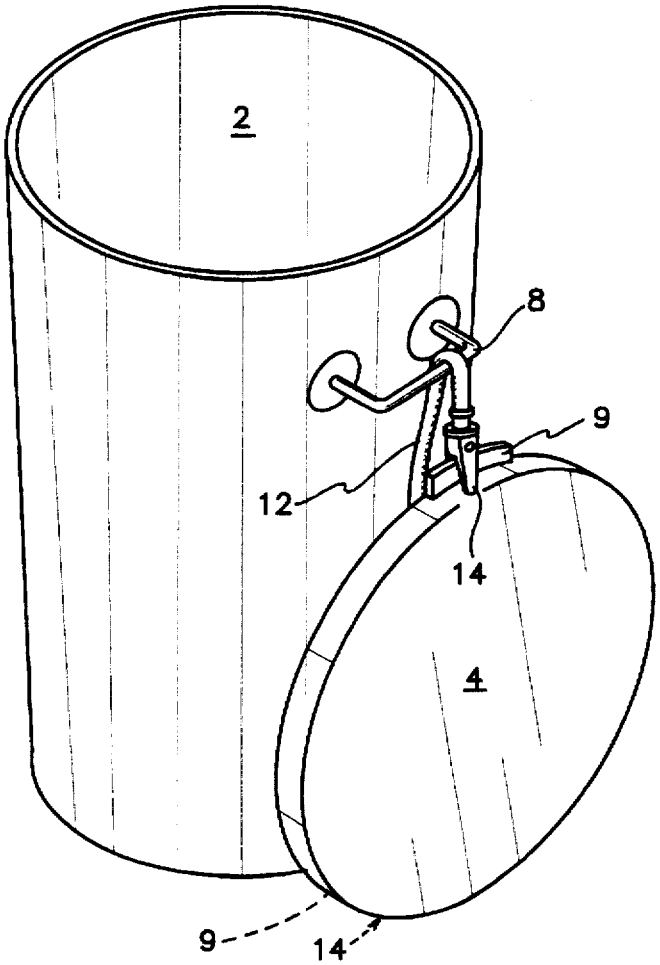

GARBAGE CAN LID TETHER

BACKGROUND OF THE INVENTION

1. Field of the Invention

The present invention relates to accessories for containers having removable closures, and more particularly to an elastic, extensible strap for tethering a cover to its associated container. The novel tether is linear and has a screw fastened, jawed clamp at each end. The tether clamps to the lid of a garbage can at diametrically opposed handles of the lid, and is passed through a handle of the can.

2. Description of the Prior Art

Retention of a lid on a garbage can is a notoriously old and vexatious problem. Lids are accidentally removed or dislodged should the garbage can topple over due to human or natural causes. Animals are prone to rifle contents of garbage cans, and it is well within their abilities to remove the lid. Loss of a lid enables animals to strew garbage in the vicinity of the garbage can, and at the least enables objectionable odors to spread.

Garbage is by its nature objectionable to smell, handle, and for some, even to see. Therefore, restoring a removed lid to a garbage can and cleaning up any consequent mess caused by strewn garbage is highly objectionable.

Loss of a lid can further lead to damage to the lid, if mishandled, stepped on, or driven over. Therefore, for many reasons, it is highly desirable to assure that a lid placed on a garbage can remain there.

The prior art has suggested a number of solutions to this problem. U.S. Pat. No. 4,009,897, issued to Michael P. Spellman on Mar. 1, 1977, illustrates a resilient tether for securing a lid on a garbage can, and the closed garbage can to a post. Spellman's tether forms a tee, with a small loop formed at each of the three ends of the legs of the tee. By contrast, the tether of the present invention has a single linear member, when drawn tight. Rather than loops, the present invention has screw fastened jawed clamps and swiveling attachment of the clamps to the linear tether.

A tether for securing a lid on place over a garbage can is the subject of U.S. Pat. No. 4,413,851, issued to Herbert W. Ritter on Nov. 8, 1983. Ritter's tether is linear, having a buckle at one end and a snap at the other end. By contrast, the present invention has screw fastened jawed clamps at both ends, and swiveling attachment of the clamps to the linear tether.

U.S. Pat. No. 4,723,686, issued to Ricky C. Pennisi on Feb. 9, 1988, describes a garbage can lid having integral projections for interlocking with corresponding slots formed in a radial flange formed integrally with an associated garbage can. This invention does not include a tether. By contrast, the present invention comprises a tether not integrally related to either the container or to its cover.

None of the above inventions and patents, taken either singly or in combination, is seen to describe the instant invention as claimed.

SUMMARY OF THE INVENTION

The present invention provides an elastic tether which is uniquely suitable for remaining attached to a garbage can of standard construction. At the same time, structure of the novel tether is uncomplicated, easy to assemble, and minimal in bulk and obtrusiveness.

The tether is elastic, so that it can exert continuous force against the lid of a garbage can. It has screw operated jawed clamps for maximally effective engagement of the lid. Screws, unlike springs, maintain tightness of the clamp over prolonged periods of time. Also, a jawed clamp can engage an exposed edge of an item, rather than requiring an opening for penetration by the strap of the tether. Rotation of each clamp relative to the strap of the tether is accommodated by a swivel connection, so that the strap does not have a tendency to twist.

Accordingly, it is a principal object of the invention to provide a tether for retaining the lid of a garbage can.

It is another object of the invention that the tether having at least one clamp for engaging a garbage can and its lid.

It is a further object of the invention that the clamp be capable of developing great clamping pressure.

Still another object of the invention is that the clamp be able to maintain clamping pressure over a prolonged period of time.

An additional object of the invention is to enable a tether to engage an exposed edge of a can or its lid, rather than requiring an opening to be formed in the can or its lid, for penetration of the tether therethrough.

Yet another object of the invention is to engage the garbage can by passing through the handle of the can.

It is again an object of the invention to prevent twisting of each clamp relative to the strap of the tether.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 2 is an environmental, perspective view of the invention showing tethering of a cover or lid to its associated container.

FIG. 3 is an environmental, perspective view of the invention showing a second method of use, with a cover or lid closing an associated container.

DETAILED DESCRIPTION OF THE PREFERRED EMBODIMENTS

Figure 1:
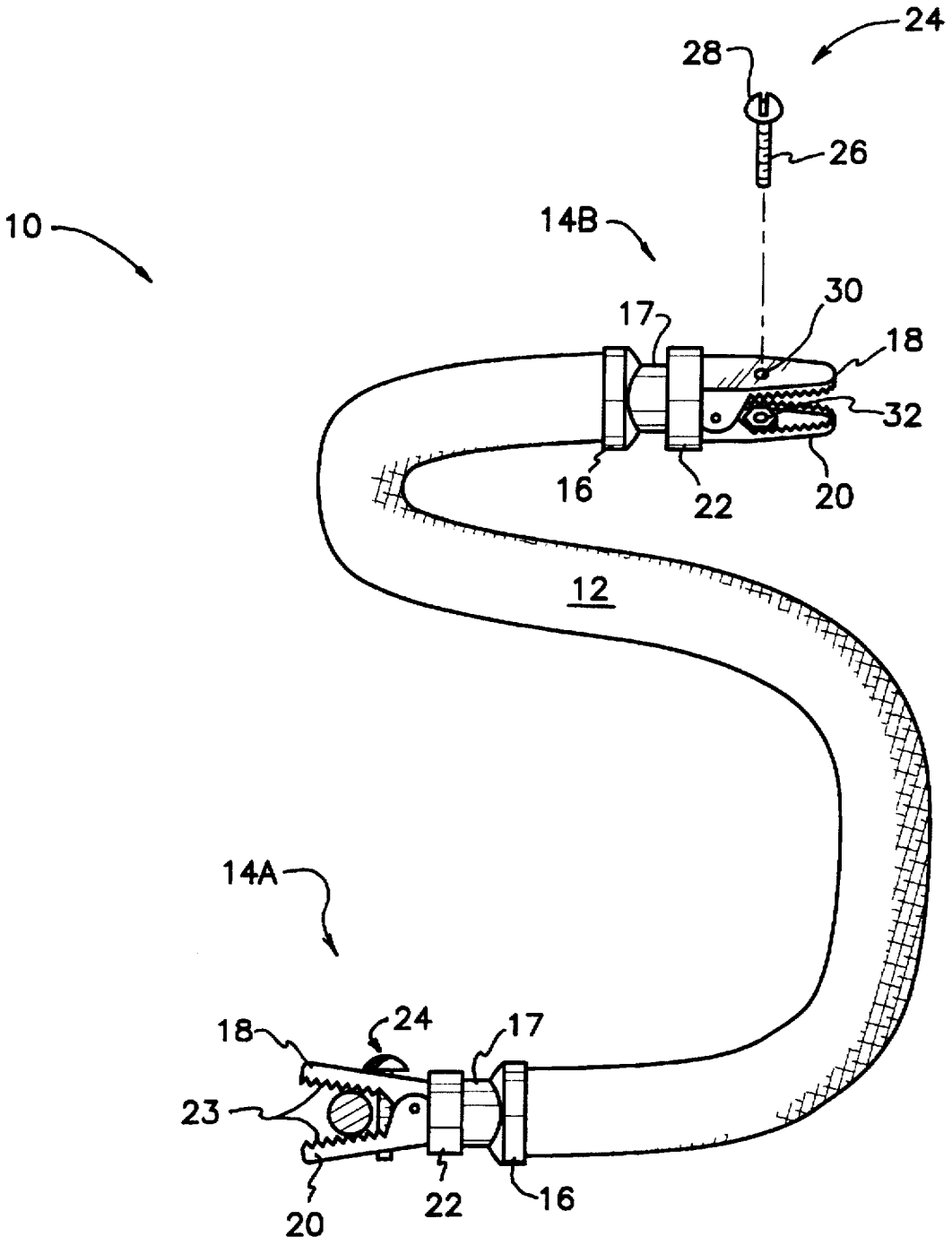
FIG. 1 is a perspective, environmental, partially exploded, partially cross sectional view of the invention.

Turning now to FIG. 1 of the drawings, the novel tether 10 is seen to comprise a flexible, elongated, linear strap 12 having two ends, and two clamps 14. Strap 12 is elongated and linear only in the sense of defining its dimensions as much greater in length than in diameter, and its structure as non-branching. Strap 12 is preferably elastic in nature, in that if stretched, it will spontaneously attempt to return to its original length. This property causes strap 12 to maintain tension after being installed on a container 2 and its cover 4 (see FIG. 2). Also, elasticity provides a small amount of slack when strap 12 is stretched, for enabling maneuvering of cover 4 over container 2. A bungee cord is a suitable product for providing strap 12.

In FIG. 1, clamp 14A at the left of the drawing is shown closed over a rod, which could be part of a handle 8 (see FIG. 2) of a container 2 (see FIG. 2). Clamp 14B is depicted open. Hereinafter, both clamps will be referred to as clamp 14, since they are essentially identical to one another. Clamp 14 is attached to one end of strap 12, such as by connection to a crimped metal cap 16 terminating strap 12. Connection of clamp 14 to cap 16 incorporates therebetween a swivel bearing or joint 17 enabling continuous and endless rotation about the longitudinal axis (not shown) of strap 12.

Clamp 14 has two jaws 18, 20 which are hinged at a supporting member 22 and preferably bear teeth 23 for engaging container 2. Preferably, member 22 includes structure for closing jaws 18, 20, in the forms of a self-locking over-center cam arrangement (not shown in detail) or other device (not shown) for self-locking, and a screw closure arrangement. Over-center cam arrangements are well known and will not be set forth in further detail.

The screw closure arrangement comprises a screw 24 or any other suitable threaded fastener having a threaded shaft 26 and an enlarged head 28. Jaw 18 has a hole 30 of diameter greater than that of threaded shaft 26. Shaft 26 passes through hole 30 and engages a threaded hole 32 formed in jaw 20. Holes 30 and 32 are mutually aligned to enable screw 24 to penetrate holes 30, 32 simultaneously. As screw 24 is turned into hole 32, jaw 18 is entrapped under and forced downwardly by interference with enlarged head 28. Screw 24 thus urges jaw 18 towards mutual abutment with jaw 20.

The purpose of the self-locking cam arrangement is to provide initial immobilization of the two jaws as they entrap container 2. This immobilization is insufficient to maintain grip of clamp 14 on container 2 over a protracted period of time or in the event that container 2 is pushed over, but is adequate to maintain clamp 14 in place so that the user' hands are freed to tighten screw 24. Screw 24 both applies great force to jaws 18, 20, and also maintains this force for a prolonged period of time.

Referring now to FIG. 2, tether 10 is passed through a handle 8 of container 2 and is clamped to any suitable part of cover 4. It is preferred that clamps 14 be attached to diametrically opposed handles 9 in the case of covers having handles 9 arranged to engage container 2 by snap action. It will be seen that removal of cover 4 from container 2 maintains cover 4 in close proximity to container 2, where little damage to cover 4 is likely.

FIG. 3 illustrates tether 10 in an alternative method of use as it is installed on container 2, with cover 4 in place closing container 2. Strap 12 passes through the central handle 6 of cover 5, where cover 5 is provided as an alternative to cover 4. Clamps 14 each engage a portion of container 2, such as handles 8. Even if cover 5 should be dislodged from its position closing container 2, it will be maintained in close proximity to container 2 and will therefore be likely to escape damage and loss.

It is to be understood that the present invention is not limited to the embodiments described above, but encompasses any and all embodiments within the scope of the following claims.

I claim:

1. A cover clamping tether for securing a cover to an associated container, comprising:

a flexible, elongated, elastic linear strap having an elongated axis, a first end and a second end each end terminating in a crimped cap;

two swivel clamps, each said swivel clamp attached to one said crimped cap at one end of said strap, each said swivel clamp having swivel means, jaw support means, a first jaw bearing teeth, a second jaw bearing teeth, and screw closure means for urging said first jaw and said second jaw towards mutual abutment, said screw closure means comprising a threaded fastener having a threaded shaft and an enlarged head, one of said first jaw and said second jaw having a threaded hole cooperating with said threaded fastener, and the other one of said first jaw and said second jaw having a diameter greater than that of said threaded shaft, whereby said threaded fastener can thread into one of said first jaw and said second jaw, and clamp the other one of said first jaw and said second jaw by entrapment under said enlarged head of said threaded fastener; wherein said swivel means is disposed between said law support means and said crimped cap to allow free rotation of said jaw support means without twisting said strap about said elongated axis or stressing said crimped cap, and said screw closure means acts to firmly secure each said swivel clamp to either the cover or the container.

2. A method of securing a cover having a lifting handle to a container having a carrying handle with said cover clamping tether as claimed in claim 1, comprising the steps of;

tightening said first and second jaws with said screw closure means at said first end of said tether to said carrying handle on said container thereby firmly securing said first end of said tether to said container, passing the second end of said tether, including said other first and second jaws with screw closure means, through a passage in said lifting handle of said cover, tightening screw closure means of the second end to said carrying handle on said container thereby also firmly securing said second end of said tether to said container, wherein said cover may be lifted from said container for emptying without detaching said tether and without separation of said cover from said container.

3. A method of securing a cover having at least one lifting handle to a container having a carrying handle with said cover clamping tether as claimed in claim 1, comprising the steps of;

tightening said first and second jaws with said screw closure means at said first end of said tether to a first lifting handle on said cover thereby firmly securing said first end of said tether to said cover, passing the second end of said tether, including said other first and second jaws with screw closure means, through a passage in said carrying handle of said container, tightening said screw closure means of the second end to a second lifting handle on said cover thereby also firmly securing said second end of said tether to said cover, wherein said cover may be lifted from said container for emptying without detaching said tether and without separation of said cover from said container.

* * * * *